United States Patent [19]

Oros et al.

[11] Patent Number: 4,938,899

[45] Date of Patent: Jul. 3, 1990

[54] GAS DIFFUSION SYSTEM

[76] Inventors: Leo J. Oros; Leo E. Oros, both of 2924 Brakley Dr., Unit B-4, Baton Rouge, La. 70816

[21] Appl. No.: 251,536

[22] Filed: Sep. 30, 1988

[51] Int. Cl.[5] ..... B01F 3/04

[52] U.S. Cl. ..... 261/123; 261/124

[58] Field of Search ..... 261/123, 124

[56] References Cited

U.S. PATENT DOCUMENTS

| | | | |
|---|---|---|---|
| 1,114,874 | 10/1914 | Fox et al. | 261/123 |
| 3,228,526 | 1/1966 | Ciabattari et al. | 261/123 |
| 3,336,016 | 8/1967 | Schreiber | 261/124 |
| 3,696,029 | 10/1972 | Walker | 210/14 |
| 3,756,580 | 9/1973 | Dunn | 261/124 |
| 3,931,370 | 1/1976 | Murphy | 261/123 |
| 4,070,423 | 1/1978 | Pierce | 261/123 |
| 4,203,841 | 5/1980 | Shimizu et al. | 261/123 |
| 4,233,269 | 11/1980 | Koye et al. | 261/123 |
| 4,421,696 | 12/1983 | Graue et al. | 261/124 |

FOREIGN PATENT DOCUMENTS

| | | | |
|---|---|---|---|
| 1519644 | 8/1978 | United Kingdom | 261/123 |

*Primary Examiner*—Tim Miles

*Attorney, Agent, or Firm*—Daniel V. Thompson

[57] ABSTRACT

A gas diffusion system for use in aeration treatment of water, sewage, industrial waste and the like is provided. Gas is released from a lower gas diffuser and rises under the influence of buoyancy and impinges upon an upper gas diffuser having a larger maximum dimension than the lower gas diffuser. In preferred form, a draft conduit is utilized to cause pumping of liquid from the bottom of the liquid tank.

20 Claims, 2 Drawing Sheets

GAS DIFFUSION SYSTEM

TECHNICAL FIELD

The present invention relates to devices for diffusing gas into liquid, and more particularly to a system to be submerged in a liquid for the efficient contacting of air or other gas to a liquid in the aeration treatment of water, fluids, industrial wastes, processed liquids, or the like.

BACKGROUND ART

Gas diffusion devices and systems have long been used to control the distribution of gas in processes which require aeration treatment. In such processes, the gas diffusion system is located below the liquid surface and is connected to a source of gas supply.

One type of gas diffusion device known in the art is constructed of a porous medium. Numerous small openings in the porous medium break the gas into small bubbles thereby increasing the gas/liquid contact. A drawback of the prior art porous device is that the porous medium has a tendency to clog, thereby reducing or completely stopping the aeration process.

Another type of gas diffusion device known in the art is the hollow-body diffuser, such as that shown in U.S. Pat. No. 4,421,696 to Graue, et al. The Graue et al diffuser is a hollow body having a plurality of slot-shaped ports disposed in a vertical distribution tube through which gas is released. Immediately above the distribution tube is a frustro-conical directional distribution surface upon which the gas streams exiting the ports impinge. The directional distribution surface evenly distributes the gas streams as they rise. The frustro-conical directional distribution surface terminates at a shear edge upon which gas bubbles are dispersed to the liquid. A plurality of drift control vanes are provided to equalize the spread of gas streams exiting each part. While the Graue, et al diffuser has been highly successful in many applications, it has been found that the prior diffuser alone is less than optimum as regards energy use and aeration efficiency in certain applications, such as those requiring deep aeration.

SUMMARY OF THE INVENTION

The present invention provides an improved system for diffusing gas into a liquid which substantially improves or eliminates the aforesaid deficiencies in prior art diffusion systems. In preferred form, the system of the present invention includes a lower gas diffuser constructed in accordance with the Graue, et al patent described above. The lower gas diffuser is gas-tightly connected to a conduit extending out of the liquid to a source of gas supply. Mounted above the lower gas diffuser on the conduit is an upper gas diffuser which includes a gas distribution surface having a larger maximum dimension than a lower gas distribution surface on the lower gas diffuser. Bubbles released from the lower gas diffuser impinge upon the upper gas distribution surface for further distribution and mixing. Preferably, a draft conduit extends between a location adjacent the upper gas diffuser to a location in proximity to the tank bottom. The lower gas diffuser is enclosed by the draft conduit, such that liquid is pumped up through the draft conduit by the action of bubbles, thereby maintaining a homogeneous mixture of tank contents.

BRIEF DESCRIPTION OF THE DRAWINGS

A more complete understanding of the invention and its advantages will be apparent from the Detailed Description taken in conjunction with the accompanying Drawings in which.

DETAILED DESCRIPTION

Figure 1:
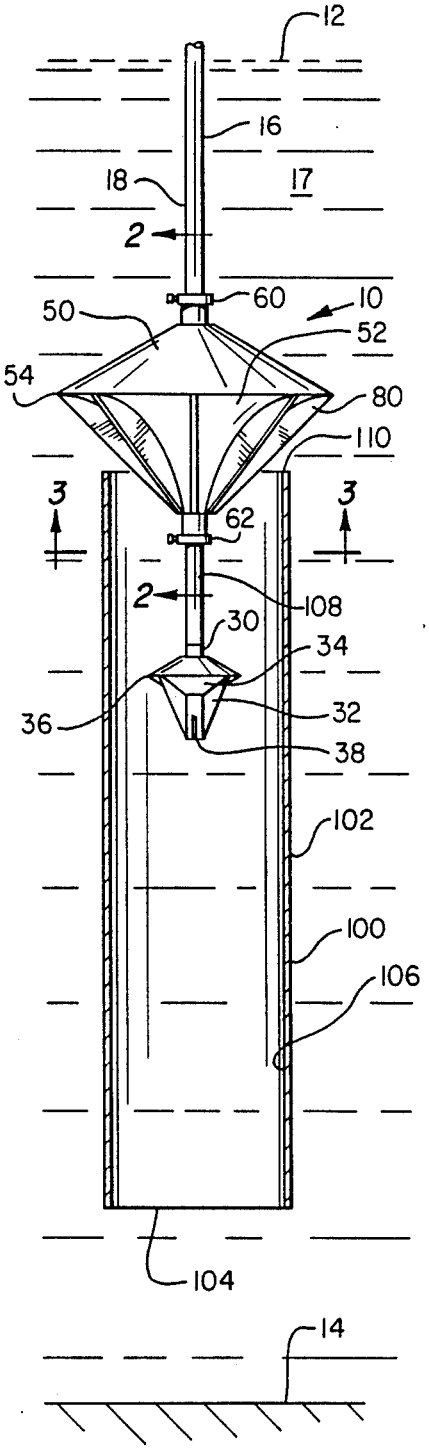
FIG. 1 is a partially broken-away side view of a gas diffusion system constructed in accordance with the invention.
Figure 2:
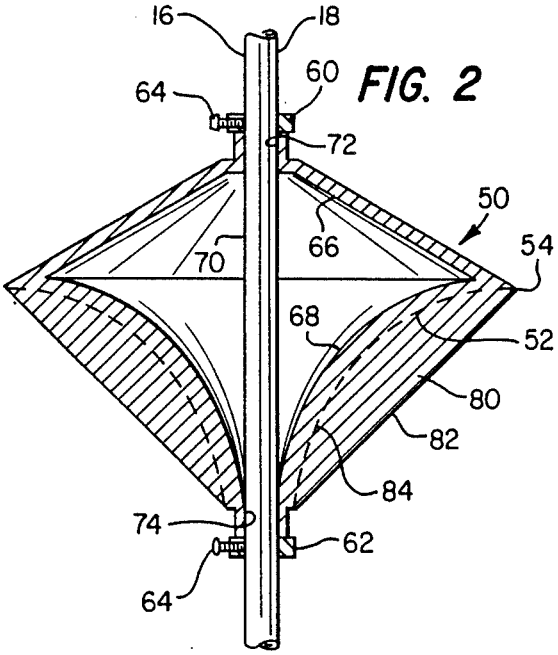
FIG. 2 is a sectional view taken along lines 2—2 of FIG. 1.
Figure 3:
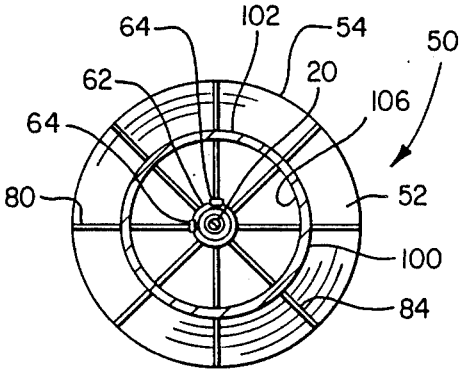
FIG. 3 is a sectional view taken along lines 3—3 of FIG. 1.

Referring initially to FIGS. 1, 2 and 3, gas diffusion system 10 is intended for use in connection with a liquid-filled tank having a liquid top surface 12 and a tank bottom surface 14. System 10 includes a gas conduit 16 extending downwardly into the liquid 17. Gas conduit 16 is a tubular member having a vertical central axis with a cylindrical exterior surface 18 and a cylindrical inner surface 20 (FIG. 3). Gas conduit 16 includes an upper means for coupling (not shown) the interior surface 20 to a source of gas supply (not shown).

Conduit 16 terminates at a lower means for coupling 30, where a lower gas diffuser 32 is gas-tightly connected to conduit 18. In the preferred embodiment of the invention, lower gas diffuser 32 is a gas diffuser constructed in accordance with the Graue, et al patent identified above. The disclosure of the Graue, et al patent, U.S. Pat. No. 4,421,696 issued Dec. 20, 1983, is hereby expressly incorporated herein by reference. Lower gas diffuser 32 includes a lower gas distribution surface 34, a lower shear edge 36, and a plurality of gas outlets 38. Lower gas distribution surface 34 has a maximum dimension defined by shear edge 36. In other words, the maximum dimension of lower gas distribution surface 34 is defined herein as the length of shear edge 36, that is, the circumference of shear edge 36. In the event an equivalent but non-circular cross-sectioned shear edge is utilized, the total perimeter of the shear edge would define the maximum dimension of lower gas distribution surface 34.

Figure 4:
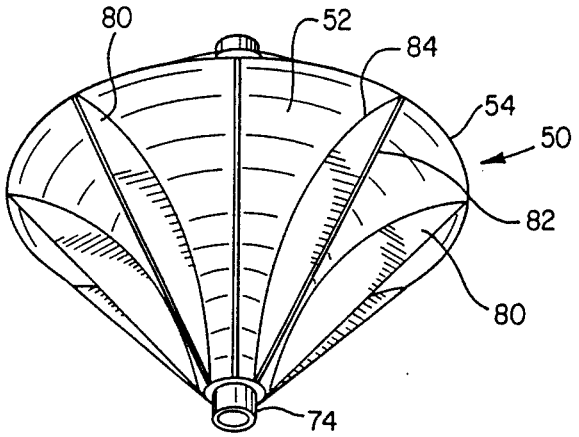
FIG. 4 is a perspective view of the upper gas diffuser illustrated in FIGS. 1, 2 and 3.

Referring now to FIG. 4 in addition to FIGS. 1, 2 and 3, an upper gas diffuser 50 is fixed with respect to the exterior surface 18 of gas conduit 16 at a pre-determined distance above lower gas diffuser 32. Upper gas diffuser 50 includes an upper gas distribution surface 52 terminating at an upper shear edge 54. As shown in FIG. 1, upper gas distribution surface 52 is vertically spaced apart from lower gas distribution surface 34 on lower gas diffuser 32.

Upper gas diffuser 50 is supported by the exterior surface 18 of gas conduit 16 by way of collars 60 and 62. Collars 60 and 62 include clamping screws 64 for engagement with exterior surface 18 of gas conduit 18 in conventional fashion.

Upper gas diffuser 50 includes interior walls 66 and 68 defining a passageway therethrough and enclosing a portion 70 of gas conduit 16. Upper gas diffuser 50 also includes upper and lower portions 72 and 74 formed by cylindrical walls being sized slightly more largely than exterior wall 18 of gas conduit 16. As shown in FIG. 2, collars 60 and 62 vertically fix upper gas diffuser with respect to gas conduit 18, but no portion of upper gas diffuser 50 is in communication with the interior wall 20 of gas conduit 16.

Upper gas distribution surface 52 is bell-shaped and coaxial with the vertical central axis of the lower distribution surface 34 and gas conduit 18. Upper gas distribution surface 52 diverges in an upward direction and is concave outwardly and downwardly, as best shown in FIGS. 2 and 4. Upper gas distribution surface 52 terminates at a sharp circular upper shear edge 54, and upper gas distribution surface 52 extends from lower portion 74.

A plurality of drift control vanes 80 extend from the lower portion 74 to shear edge 54. The drift control vanes are equally spaced radially from the vertical central axis of upper gas diffuser 50. Each drift control vane 80 includes a linear outer edge 82 and a curved inner edge 84 coextensive with upper gas distribution surface 52. Each drift control vane 80 is planar and extends outwardly in a radial direction from the vertical central axis of gas diffuser 50.

In preferred form, system 10 includes a draft conduit 100 comprising a tubular member coaxially fixed with respect to upper and lower gas diffusers 50 and 32 and gas conduit 16. Draft conduit 100 has a circular lower opening 104 located adjacent to but spaced apart from tank bottom surface 14 to allow ingress of liquid therethrough. Cylindrical interior walls 106 enclose lower gas diffuser 32, portion 108 of gas conduit 16, and at least a portion of upper gas diffuser 52 as shown in FIGS. 1 and 3. Draft conduit 100 has a circular upper opening 110 located in proximity to but spaced apart from upper gas distribution surface 52 and edges 82 of drift control vanes 80.

Upper gas distribution surface 50 has a maximum dimension defined by the perimeter of upper shear edge 54, in the same fashion as the maximum dimension of lower gas distribution surface 34 is defined as described above. In preferred form, as shown in FIG. 1, upper shear edge 54 has a larger perimeter than lower shear edge 36, such that upper gas distribution 52 has a larger maximum dimension than lower gas distribution surface 34.

Figure 5:
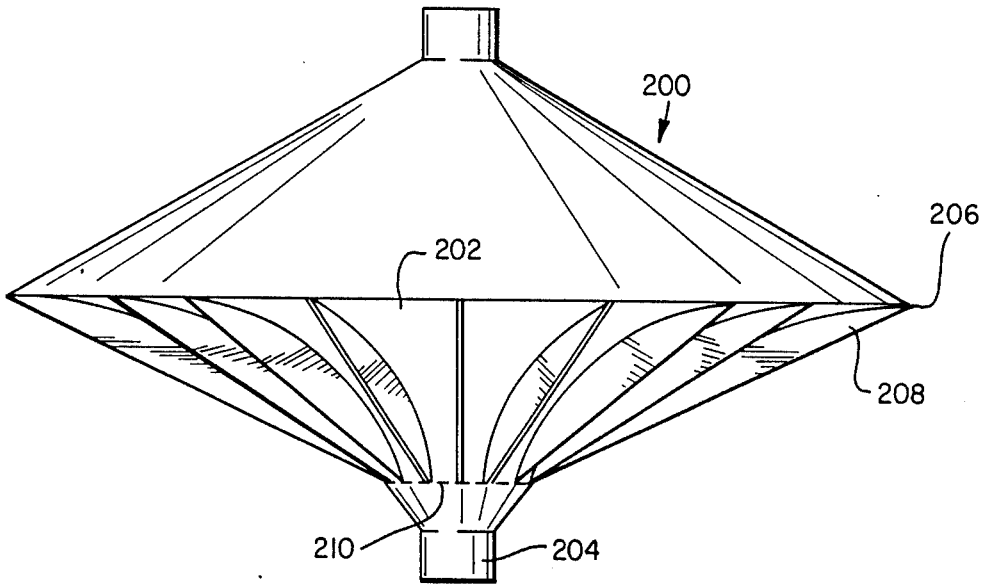
FIG. 5 is a side view of an alternate embodiment of an upper gas diffuser usable in accordance with the present invention.

Referring now to FIG. 5, upper gas diffuser 200 is an alternate embodiment of upper gas diffuser 50 shown in FIGS. 1, 2, 3 and 4. Upper gas diffuser 200 can be utilized when an increased diameter upper gas diffuser is preferred. In this alternate embodiment, a bell-shaped upper gas distribution surface 202 extends between a lower opening 204 and an upper shear edge 206. In this embodiment, however, drift control vanes 208 do not extend to lower portion 204 but terminate at an intermediate location defined by dotted line 210.

In operation, the preferred embodiment includes a gas conduit 16 having a one inch diameter with a draft conduit 100 having a 12 inch diameter. Draft tube 100 could be as long as 15 to 20 feet long in a tank having a liquid depth of 30 feet. Lower opening 104 is typically located 1 to 2 feet above tank bottom 14 and is supported independently of gas conduit 18, lower gas diffuser 32 and upper gas diffuser 50. Preferably, lower diffuser 32 is located at least one-third the distance from the upper opening 110 of draft conduit 100.

Upper and lower gas diffusers 50 and 34 are manufactured from ABS plastic and have high impact characteristics, as well as the ability to retain their original mechanical properties. Aerobic digesters, anaerobic digesters, and the like can be completely aerated in an energy efficient manner, because as bubbles are released from lower gas diffuser 34 they rise through draft tube 100 causing a pumping action of liquid. The air and water mixture resulting from the pumping action is directed in a horizontal direction by upper gas distribution surface 52. Drift control vanes 80 prevent coalescence while directing and equally separating the air/water mixture. Because of the strong pumping action, many air bubbles remain entrapped in the system. Greater energy efficiency is achieved because the vertical elevation of the gas outlet ports may be submerged at a location having less depth than with other aeration methods. One skilled in the art will readily appreciate that energy use is directly related to the depth of the gas outlet location.

While particular embodiments of the present invention have been described in detail herein and illustrated in the accompanying drawings, it will be evident that various further modifications are possible without departing from the scope of the invention.

We claim:

1. A gas diffusion system for use in connection with a liquid-filled tank having a liquid top surface and a tank bottom surface, comprising:

a gas conduit extending downwardly into the liquid, said gas conduit having interior and exterior surfaces and having upper means for coupling said interior surface of said gas conduit to a source of gas supply, said gas conduit terminating at a lower means for coupling being located below the liquid top surface;

a lower gas diffuser gas-tightly coupled to said lower means for coupling, said lower gas diffuser having gas outlets in communication with the interior of said gas conduit for releasing gas into the liquid, and said lower gas diffuser further having a lower gas distribution surface terminating at a lower shear edge for directionally distributing gas from said gas outlets to said shear edge; and an upper gas diffuser fixed with respect to said exterior surface of said conduit at a predetermined distance above said lower gas diffuser, said upper gas diffuser having an upper gas distribution surface terminating at an upper shear edge and being vertically spaced apart from said lower gas distribution surface.

2. The gas diffusion system of claim 1 wherein said upper gas distribution surface has a larger maximum dimension than said lower gas distribution surface.

3. The gas diffusion system of claim 1 further comprising a draft conduit having an upper opening located in proximity to said upper gas diffuser and a lower opening located in proximity to the tank bottom surface.

4. The diffusion system of claim 3 wherein said draft conduit comprises a tubular member.

5. The gas diffusion system of claim 1 wherein said upper gas diffuser is supported by the exterior surface of said gas conduit.

6. The gas diffusion system of claim 5 wherein said upper gas diffuser includes interior walls defining a passageway therethrough, said passageway enclosing a portion of said exterior surface of said gas conduit.

7. The gas diffusion system of claim 6 wherein collars are fixed to said exterior surface of said gas conduit at upper and lower locations with respect to the upper gas diffuser to fix said upper gas diffuser with respect to said exterior surface.

8. The gas diffusion system of claim 1 wherein said upper gas distribution surface has circular cross-sections.

9. The gas diffusion system of claim 8 wherein said upper gas distribution surface has a bell-shaped cross-section.

10. The gas diffusion system of claim 9 wherein said upper gas distribution surface is bell-shaped from a lower portion located in proximity to said exterior surface of said gas conduit, extending outwardly and upwardly to said shear edge, with said upper gas distribution surface being concave outwardly and downwardly.

11. The gas diffusion system of claim 1 wherein said upper gas diffuser includes a plurality of drift control vanes disposed about the upper gas distribution surface.

12. The gas diffusion system of claim 11 wherein said drift control vanes extend to the shear edge.

13. The gas diffusion system of claim 12 wherein said drift control vanes are equally spaced about the upper gas distribution surface.

14. The gas diffusion system of claim 4 wherein said draft conduit has cylindrical interior and exterior surfaces and circular upper and lower openings perpendicular to a vertical central axis of said tubular member.

15. The gas diffusion system of claim 14 wherein said draft conduit encloses said lower gas diffuser and partially encloses said upper gas diffuser.

16. The gas diffusion system of claim 15 wherein said upper opening of said draft conduit is located in proximity to but spaced apart from said upper gas distribution surface.

17. The gas diffusion system of claim 16 wherein said upper opening of said draft conduit has a smaller dimension than said upper shear edge.

18. The gas diffusion system of claim 16 wherein said lower opening of said draft conduit is spaced apart from said tank bottom surface.

19. A gas diffusion system for use in connection with a liquid-filled tank having a liquid top surface and tank bottom surface, comprising:

(a) a tubular gas conduit having a vertical central axis and extending downwardly into the liquid, said gas conduit having interior and exterior surfaces and having upper means for coupling said interior surface of said gas conduit to a source of gas supply, the gas conduit terminating at a lower means for coupling being located below the liquid top surface;

(b) a lower gas diffuser comprising:

(i) coupling means for rigidly and gas-tightly connecting the lower gas diffuser to the gas conduit;

(ii) a frustro-conical lower gas distribution surface having a vertical central axis and diverging in an upward direction to terminate at a sharp circular lower shear edge, said lower gas distribution surface being attached to said coupling means;

(iii) a distribution tube attached to said lower gas distribution surface and extending in a downward direction from said lower gas distribution surface;

(iv) a plurality of port edges disposed in said distribution tube which define a plurality of slot-shaped distribution ports beneath said lower gas distribution surface such that gas streams escaping from said distribution ports rise under the influence of buoyancy, impinge upon said lower gas distribution surface, are evenly distributed to said lower shear edge, and are dispersed at the lower shear edge as bubbles; and (v) a plurality of drift control vanes extending from said distribution tube to said lower shear edge to control the distribution of gas streams to said lower shear edge; and (c) an upper gas diffuser comprising:

(i) cylindrical walls defining upper and lower portions closely spaced to said exterior surface of said gas conduit;

(ii) means for vertically fixing said upper gas diffuser with respect to said gas conduit at a location vertically and upwardly spaced from said lower gas diffuser;

(iii) a bell-shaped upper gas distribution surface being coaxial with said vertical central axis of said lower gas distribution surface and further being coaxial with the vertical central axis of said gas conduit, said upper gas distribution surface diverging in an upward direction and being concave outwardly and downwardly to terminate at a sharp circular upper shear edge, said upper gas distribution surface extending from said lower portion;

(iv) a plurality of drift control vanes extending from said lower portion to said shear edge to control the distribution of gas streams to said shear edge; and (v) said upper shear edge having a larger perimeter than said lower shear edge, such that bubbles dispersed at said lower shear edge impinge upon said upper gas distribution surface, are evenly distributed to said upper shear edge, and are dispersed at said upper shear edge as bubbles.

20. The gas diffusion system of claim 19 further comprising a tubular draft conduit being coaxially fixed with respect to said upper and lower gas diffusers, said draft conduit having a circular lower opening located adjacent to but spaced apart from said tank bottom surface, said draft conduit having interior walls enclosing said lower gas diffuser, a portion of said gas conduit extending between said lower gas diffuser and said upper gas diffuser, and at least a portion of said upper gas diffuser, said draft conduit having a circular upper opening located in proximity to but spaced apart from said upper gas distribution surface and drift control vanes, such that liquid is pumped upwardly through said draft conduit under the effect of bubbles released from said lower gas diffuser and expelled outwardly by said upper gas distribution surface.

* * * * *